US006634868B2

(12) United States Patent
Yokomachi et al.

(10) Patent No.: US 6,634,868 B2
(45) Date of Patent: Oct. 21, 2003

(54) COMPRESSOR

(75) Inventors: Naoya Yokomachi, Kariya (JP); Tatsuya Koide, Kariya (JP); Masakazu Murase, Kariya (JP); Junya Suzuki, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 17 days.

(21) Appl. No.: 10/077,143

(22) Filed: Feb. 15, 2002

(65) Prior Publication Data

US 2002/0114710 A1 Aug. 22, 2002

(30) Foreign Application Priority Data

Feb. 19, 2001 (JP) ..... 2001-041921

(51) Int. Cl.[7] ..... F04B 1/12; F04B 39/10
(52) U.S. Cl. ..... 417/269; 417/569; 417/571
(58) Field of Search ..... 417/269, 560, 417/569, 571

(56) References Cited

U.S. PATENT DOCUMENTS 4,690,619 A * 9/1987 Iijima et al. ..... 417/269
4,693,674 A * 9/1987 Fukai et al. ..... 417/269
5,842,836 A * 12/1998 Tarutani et al. ..... 417/269
6,250,204 B1 6/2001 Kuhn et al. ..... 92/12.2

FOREIGN PATENT DOCUMENTS

JP 08-219022 8/1996 ..... F04B/39/12
JP 11-303743 11/1999 ..... F04B/39/00

* cited by examiner

*Primary Examiner*—Charles G. Freay
*Assistant Examiner*—Timothy P. Solak
(74) *Attorney, Agent, or Firm*—Morgan & Finnegan, LLP

(57) ABSTRACT

A compressor has a housing and a cylinder block. The housing includes suction and discharge chambers. The cylinder block is fixed to the housing via a valve plate assembly. The valve plate assembly forms suction and discharge ports and suction and discharge valves. A partition wall is formed with the housing, and separates the suction chamber and the discharge chamber. The housing includes a first surface, and the cylinder block includes a second surface. At least one of the first and second surfaces is concave in shape. The cylinder block is screwed to the housing at the partition wall or a position closer to the central axis of the housing than the partition wall by a bolt so that the first surface faces the second surface.

10 Claims, 3 Drawing Sheets

COMPRESSOR

BACKGROUND OF THE INVENTION

The present invention relates to a compressor. More particularly, the present invention relates to a structure of the compressor that improves sealing performance at facing surfaces of a housing and a cylinder block.

A piston type compressor such as a swash plate type compressor generally includes suction and discharge chambers defined in a housing such that a partition wall separates the suction and discharge chambers. A cylinder block facing the suction and discharge chambers is disposed in the housing so as to sandwich a valve plate assembly. Cylinder bores each slidably accommodate respective pistons. Refrigerant gas in the suction chamber is sucked into the cylinder block and the refrigerant gas in the cylinder block is discharged to the discharge chamber by reciprocation of the pistons. Due to the suction and discharge of the refrigerant gas, large pressure difference arises at the partition wall.

To improve sealing performance at the partition wall, Japanese Unexamined Patent Publication No. 11-303743 discloses a compressor that includes the convex end of a cylinder head facing the partition wall of the housing.

Sealing performance at the partition wall improves because pressure applied to the partition wall increases due to the convex end of the cylinder head. However, an unwanted effect is that sealing performance at the cylinder head adjacent to the outer periphery is deteriorated because pressure applied to the surface of the cylinder head adjacent to the outer periphery reduces.

Particularly, high sealing performance is required when refrigerant gas such as carbon dioxide is used in the compressor in a state of a relatively high pressure condition.

SUMMARY OF THE INVENTION

The present invention addresses the above-mentioned problems traceable to large pressure difference between a suction chamber and a discharge chamber by improving sealing performance at mutual facing surfaces between a housing and a cylinder block.

According to the present invention, a compressor has a housing and a cylinder block. The housing includes suction and discharge chambers. The cylinder block is fixed to the housing via a valve plate assembly. The valve plate assembly forms suction and discharge ports and suction and discharge valves. A partition wall is formed with the housing, and separates the suction chamber and the discharge chamber. The housing includes a first surface, and the cylinder block includes a second surface. At least one of the first and second surfaces is concave in shape. The cylinder block is screwed to the housing at the partition wall or a position closer to the central axis of the housing than the partition wall by a bolt so that the first surface faces the second surface.

Pressure is applied to the partition wall by screwing the cylinder block to the housing. Since at least one of the first and second surfaces is concave in shape, pressure is applied to the first and second surfaces adjacent to the outer periphery after screwing the cylinder block to the housing by the bolt.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

An embodiment of the present invention will now be described with reference to FIGS. 1 through 3. The left side and the right side in FIGS. 1 through 3 correspond to the front side and the rear side, respectively.

Figure 1:
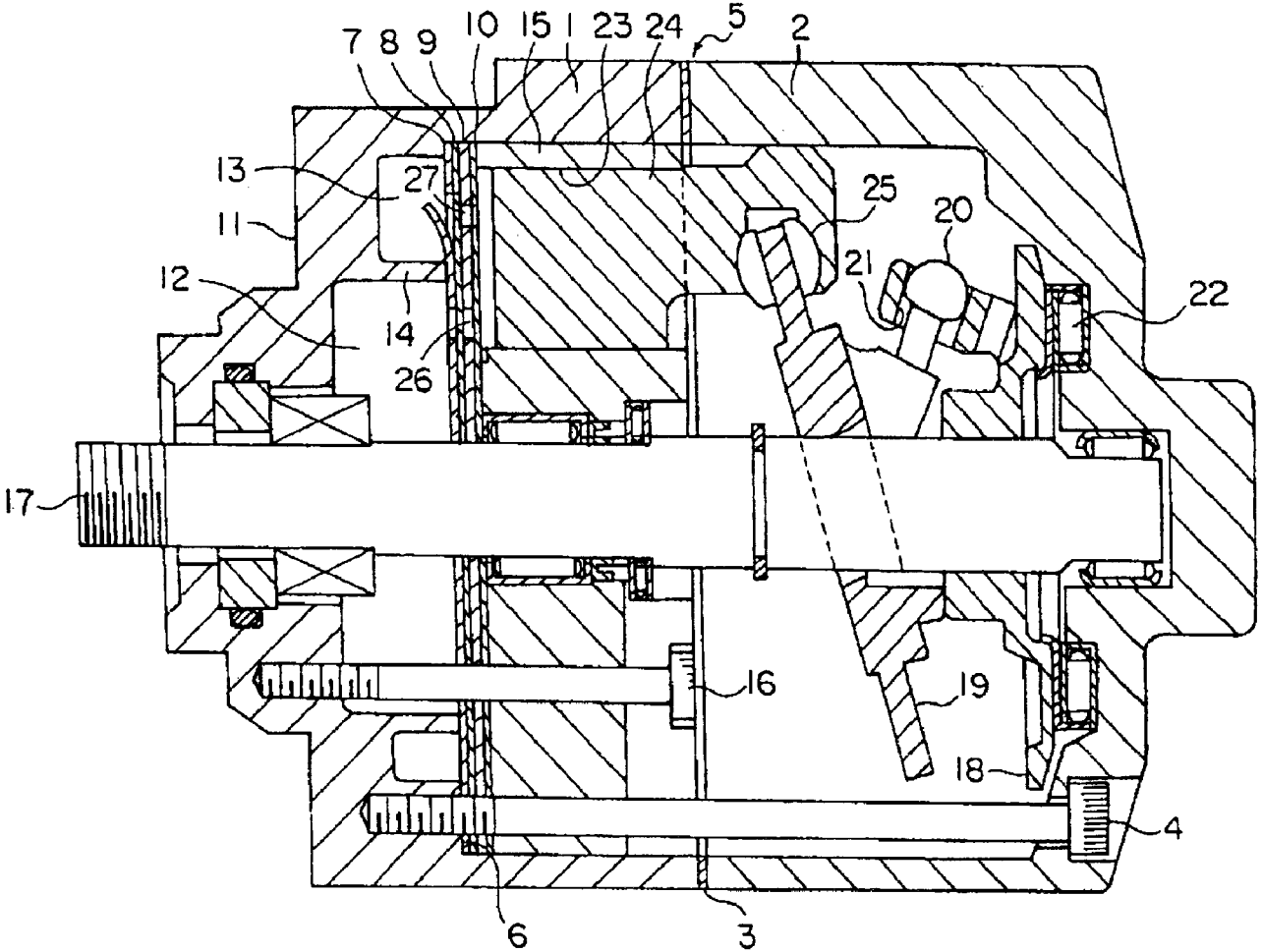
FIG. 1 is a longitudinal cross-sectional view of a swash plate type variable displacement compressor according to an embodiment of the present invention.

As shown in FIG. 1, a first bolt 4 screws a front housing 1 to a rear housing 2 via a gasket 3, thus constructing a housing 5 of a compressor. The front housing 1 provides a step 6 inside. A retainer plate 7, a discharge valve plate 8, a valve plate 9 and a suction valve plate 10 are fitted onto the step 6. A suction chamber 12 and a discharge chamber 13 are defined between the retainer plate 7 and a front end wall 11 of the front housing 1 such that a partition wall 14 separates the suction chamber 12 and the discharge chamber 13 from each other.

A cylinder block 15 is fitted onto the suction valve plate 10 in the front housing 1, and a second bolt 16 fixes the cylinder block 15 to the front housing 1. The cylinder block 15, the front housing 1 and the rear housing 2 rotatably support a drive shaft 17. The drive shaft 17 protrudes its front end outside the front housing 1, and connects with a driving source such as an engine or a motor of a vehicle, which is not shown. In the rear housing 2, a lug plate 18 is secured to the drive shaft 17, and a swash plate 19 engages with the lug plate 18. The drive shaft 17 extends through a through hole, which is formed through the center of the swash plate 19. A pair of guide pins 20 extending from the swash plate 19 is slidably fitted into a pair of guide holes 21 formed with the lug plate 18. The guide pins 20 engages with the guide holes 21 so that the swash plate 19 integrally rotates with the drive shaft 17, and the swash plate 19 is tiltably supported by the drive shaft 17 so as to slide along the axis of the drive shaft 17. Also, the lug plate 18 is rotatably supported by a thrust bearing 22, which is disposed on the inner surface of a rear end wall of the rear housing 2.

A plurality of cylinder bores 23 is defined in the cylinder block 15 so as to surround the drive shaft 17, and the cylinder bores 23 each slidably accommodate respective pistons 24. The pistons 24 each engage with the periphery of the swash plate 19 through a pair of shoes 25. As the swash plate 19 rotates with the drive shaft 17, the pistons 24 each reciprocate in the direction of the axis of the drive shaft 17 in the associated cylinder bores 23 through shoes 25.

Due to movement of the piston 24 from a top dead center toward a bottom dead center, refrigerant gas in the suction chamber 12 flows into a suction port 26 of the valve plate 9, and pushes a suction reed valve of the suction valve plate 10 aside, then flows into the cylinder bore 23. Due to movement of the piston 24 from the bottom dead center toward the top dead center, the refrigerant gas flows into a discharge port 27 of the valve plate 9, and pushes a discharge reed valve of the discharge valve plate 8 aside, then flows into the discharge chamber 13.

Figure 2:
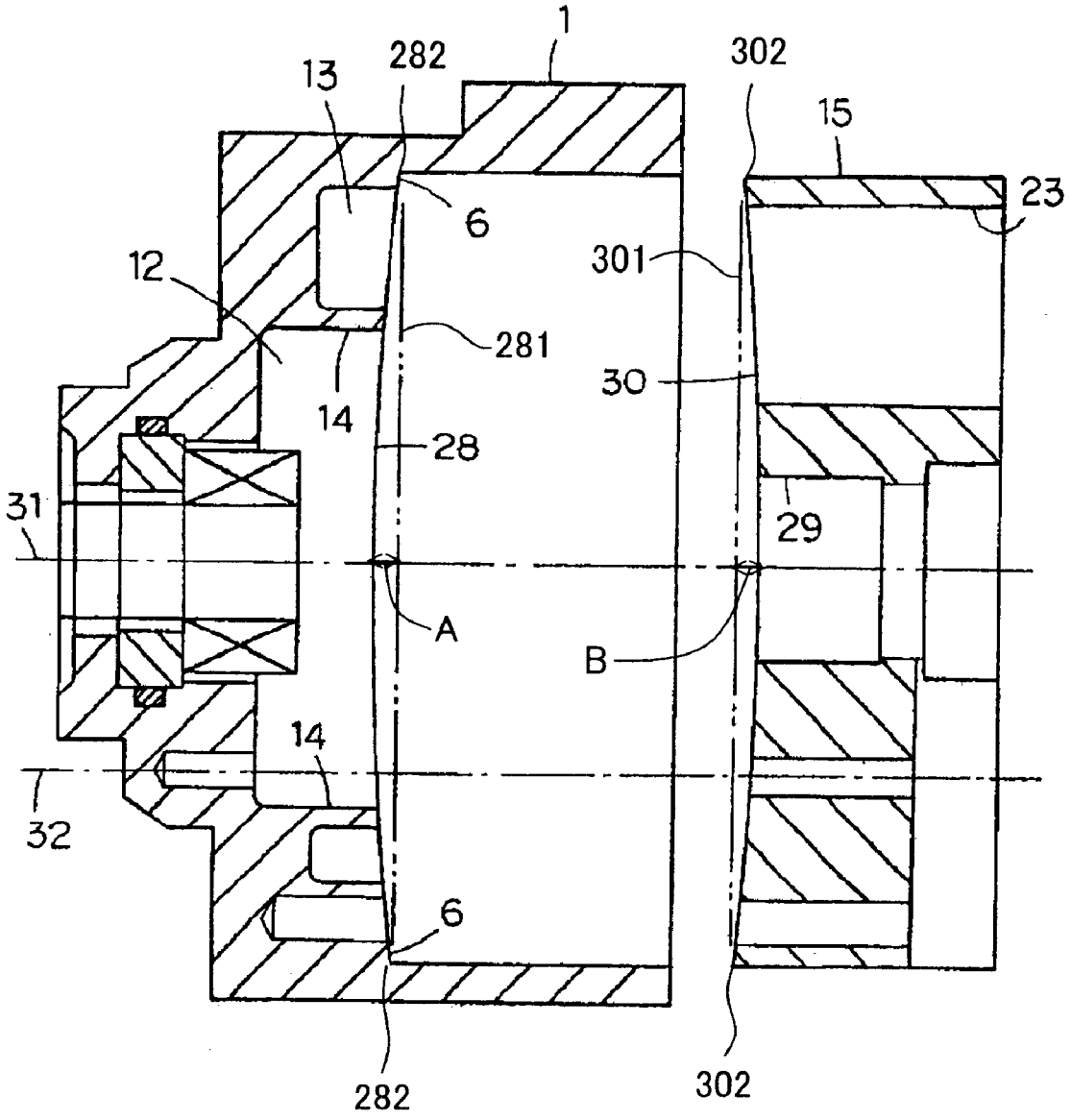
FIG. 2 is a longitudinal cross-sectional view of a front housing and a cylinder block used for the compressor in FIG. 1.

As shown in FIG. 2, the suction chamber 12 and the discharge chamber 13 are defined in the front housing 1 such that the partition wall 14 separates the suction chamber 12 and the discharge chamber 13, and the retainer plate 7 abuts against a first surface 28 including the rear end of a step 6 and the rear end of the partition wall 14. Meanwhile, cylinder bores 23 and a through hole 29 for inserting the drive shaft 17 are defined in the cylinder block 15, and the suction valve plate 10 abuts against a second surface 30. The first and second surfaces 28, 30 face each other through the retainer plate 7, the discharge valve plate 8, the valve plate 9 and the suction valve plate 10, and both the first and second surfaces 28, 30 are concave in shape.

The concave first and second surfaces are exaggeratedly illustrated in FIG. 2. A first distance or a first concave depth A along the central axis 31 as indicated by a double headed arrow is defined from the first surface 28 to a hypothetical surface 281 which extends between end points 282 in the front housing 1 as indicated by a vertical double-dotted line. Similarly, a second distance or a second concave depth B along the central axis 31 as indicated by a double headed arrow is defined from the second surface 30 to a hypothetical surface 301 which extends between end points 302 on the cylinder block 15 as indicated by another vertical double-dotted line. When the end points 282 and 302 contact in the first housing 1, a sum of the distances A and B ranges from 0.01 mm to 0.2 mm, preferably, from 0.05 mm to 0.1 mm.

The cylinder block 15 is screwed to the front housing 1 by the second bolt 16 at an axis 32 for fastening the second bolt 16, which is closer to the central axis 31 of the front housing 1 than the partition wall 14. Since the axis 32 is located inside the partition wall 14, the front housing 1 and the cylinder block 15 deform a little, such that the first and second surfaces 28, 30 become mutual parallel planes relative to each other by fastening the second bolt 16. Thereby, pressure is applied to the first and second surfaces 28, 30 at the rear end of the partition wall 14, and sealing performance is ensured. Also, since the first and second surfaces are originally concave in shape, higher pressure is applied to the step 6 of the front housing 1 and the cylinder block 15 adjacent to the outer periphery in comparison with pressure applied to the rear end of the partition wall 14 when pressure applied to the rear end of the partition wall 14 is increased by screwing the cylinder block 15 to the front housing 1 by the second bolt 16.

In the present embodiment, both the first surface 28 of the front housing 1 and the second surface 30 of the cylinder block 15 are concave in shape. However, the present invention is not limited to the embodiment described above. One of the first and second surfaces 28, 30 may be concave in shape, and the other may be flat in shape. The similar advantageous effects are obtained.

Figure 3:
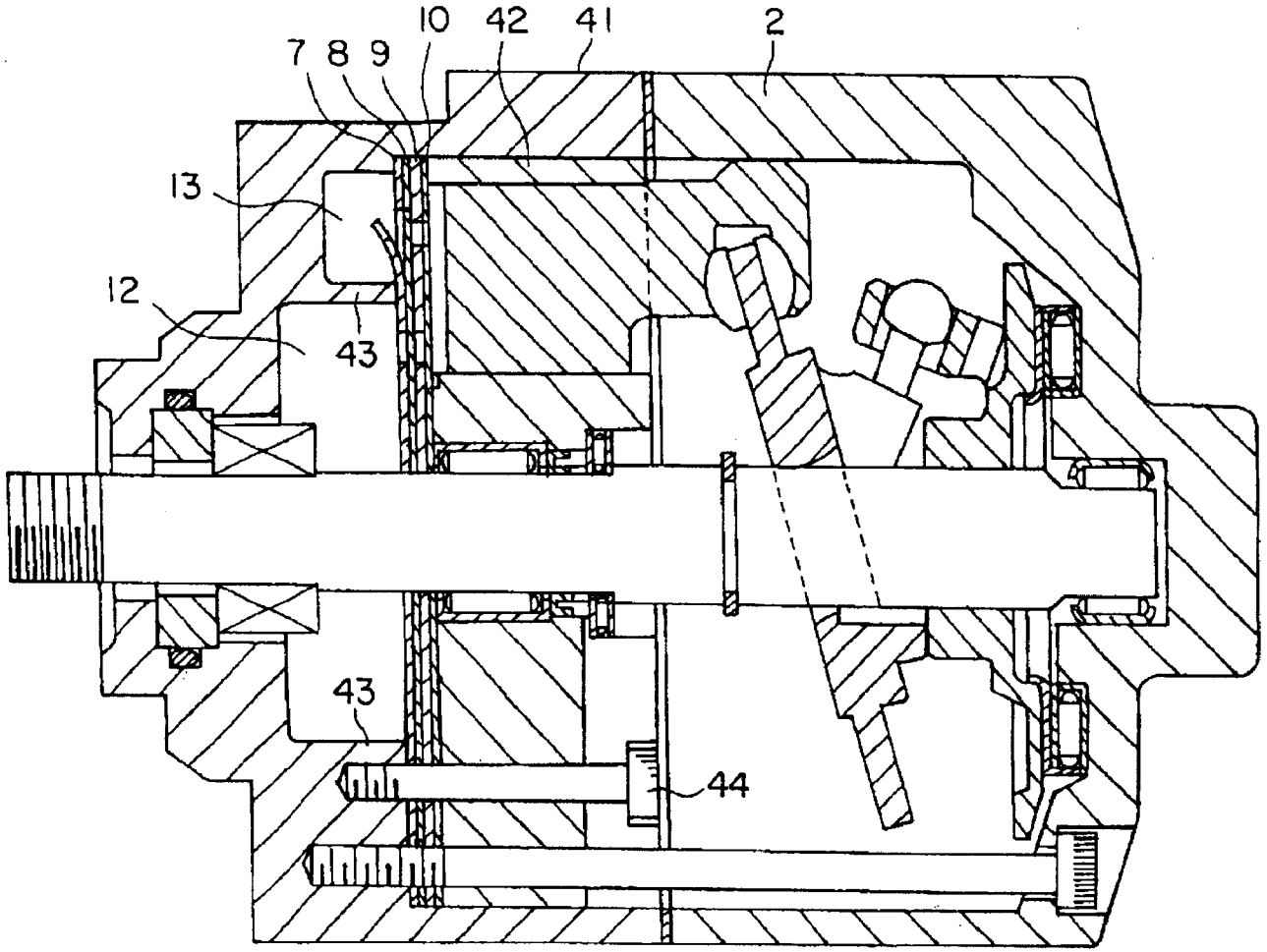
FIG. 3 is a longitudinal cross-sectional view of a swash plate type variable displacement compressor according to another embodiment of the present invention.

Also, as shown in FIG. 3, the first surface of a front housing 41 and the second surface of a cylinder block 42 are concave in shape as well as those in the embodiment described above. A second bolt 44 may screw the cylinder block 42 to the front housing 41 at a partition wall 43 of the front housing 41. In such a state, pressure is applied to the rear end of the partition wall 43 by screwing the second bolt 44, and sealing performance is ensured. Also, pressure is applied to the cylinder block 42 adjacent to the outer periphery by screwing the second bolt 44, and sealing performance is ensured.

According to the present invention described above, at least one of the first surface of the housing and the second surface of the cylinder block is concave in shape, and the cylinder block is screwed to the housing at the partition wall or a position closer to the central axis of the housing than the partition wall. Thereby, pressure is applied to the rear end of the partition wall by screwing the second bolt, and pressure is also applied to the cylinder block adjacent to the outer periphery by screwing the second bolt, thus ensuring high sealing performance. Accordingly, the present invention is especially available in using a compressor in a state of a relatively high pressure condition such that the compressor compresses refrigerant gas such as carbon dioxide.

Therefore, the present examples and embodiments are to be considered as illustrative and not restrictive and the invention is not to be limited to the details given herein but may be modified within the scope of the appended claims.

What is claimed is:

1. A compressor comprising:

a housing including suction and discharge chambers;

a cylinder block fixed to the housing;

a valve plate assembly arranged between the housing and the cylinder block, the valve plate assembly forming suction and discharge ports and suction and discharge valves;

a partition wall formed with the housing, separating the suction chamber and the discharge chamber;

a bolt for screwing the cylinder block to the housing; and wherein the housing includes a first surface and the cylinder block includes a second surface, at least one of the first and second surfaces is concave in shape, and the cylinder block is screwed to the housing at the partition wall or a position closer to the central axis of the housing than the partition wall so that the first surface faces the second surface.

2. The compressor according to claim 1, wherein both the first and second surfaces are concave in shape.

3. The compressor according to claim 1, wherein one of the first and second surfaces is concave in shape, and the other is flat in shape.

4. The compressor according to claim 1, wherein a plurality of the bolts screws the cylinder block to the housing.

5. The compressor according to claim 1, wherein the sum of a first concave depth and a second concave depth ranges from 0.01 mm to 0.2 mm.

6. The compressor according to claim 5, wherein the sum of the first concave depth and the second concave depth ranges from 0.05 mm to 0.1 mm.

7. The compressor according to claim 1, wherein the compressor is a variable displacement type.

8. The compressor according to claim 1, wherein the compressor is a piston type.

9. The compressor according to claim 1, wherein the compressor is a swash plate type.

10. The compressor according to claim 1, wherein refrigerant gas used in the compressor is carbon dioxide.

* * * * *

UNITED STATES PATENT AND TRADEMARK OFFICE

CERTIFICATE OF CORRECTION

PATENT NO. : 6,634,868 B2
DATED : October 21, 2003
INVENTOR(S) : Naoya Yokomachi et al.

It is certified that error appears in the above-identified patent and that said Letters Patent is hereby corrected as shown below:

Title page, Item [54] and Column 1, line 1,
Title, should read -- COMPRESSOR WITH A CONCAVE HEAD SURFACE --

Signed and Sealed this

Sixteenth Day of March, 2004

JON W. DUDAS
*Acting Director of the United States Patent and Trademark Office*